United States Patent [19]

Huebner

[11] 4,318,817

[45] Mar. 9, 1982

[54] PHOSPHATE ESTER FLUIDS CONTAINING PIPERAZINES

[75] Inventor: Juergen Huebner, Notre Dame De Gravenchon, France

[73] Assignee: Mobil Oil Corporation, New York, N.Y.

[21] Appl. No.: 114,139

[22] Filed: Jan. 21, 1980

[51] Int. Cl.[3] ..... C09K 5/00

[52] U.S. Cl. ..... 252/78.5; 252/77; 252/390; 252/392

[58] Field of Search ..... 252/77, 78.5, 49.9, 252/390, 392

[56] References Cited

U.S. PATENT DOCUMENTS

| | | | |
|---|---|---|---|
| 2,111,253 | 3/1938 | Stoesser et al. | 252/390 X |
| 2,164,564 | 7/1939 | Britton et al. | 252/390 |
| 2,441,793 | 5/1948 | Britton et al. | 252/77 |
| 2,814,593 | 11/1957 | Beiswanger et al. | 252/8.55 |
| 3,046,277 | 7/1962 | Anslow | 252/392 X |
| 3,089,854 | 5/1963 | Meyers et al. | 252/390 X |
| 3,167,554 | 1/1965 | Ernest | 252/390 X |
| 3,260,669 | 7/1966 | Schoen | 252/392 X |
| 3,281,360 | 10/1966 | Knapp | 252/77 X |
| 3,468,802 | 9/1969 | Nail | 252/78.5 |
| 3,868,376 | 2/1975 | Hotten | 252/49.9 X |

*Primary Examiner*—P. E. Willis, Jr.

*Attorney, Agent, or Firm*—M. G. Gilman; C. J. Speciale; C. E. Setliff

[57] ABSTRACT

Fluids based on phosphoric acid esters, or mixtures thereof, containing a corrosion and hydrolysis inhibitor, are useful fire resistant materials.

15 Claims, No Drawings

PHOSPHATE ESTER FLUIDS CONTAINING PIPERAZINES

BACKGROUND OF THE INVENTION

1. Field of the Invention

This invention relates to fire resistant (difficultly inflammable) fluids based on esters of phosphoric acid. More particularly, the invention relates to a fire resistant fluid based on a phosphoric acid ester or a mixture of phosphoric acid esters and containing a corrosion and hydrolysis inhibitor.

2. Discussion of the Prior Art

Hydraulic fluids based on phosphoric acid esters have been used for some time. They have characteristics suitable therefor; particularly, they are not easily inflammable, so that they are used above all in systems comprising closed hydraulic circuits such as hydraulic systems of turbines and of pressure casting, continuous casting and press plants. The use of such fluids is described for example in U.S. Pat. No. 3,468,802 and U.S. Pat. No. 3,723,315.

Although such fluids are not easily inflammable and of relatively high thermal stability, they may, in certain applications, possess insufficient resistance to oxidation and/or hydrolysis or they may be highly corrosive to certain metals. To remedy such defects of the known fluids certain inhibitors may be added thereto. For example, certain aminopyridines may be added as antioxidants (U.S. Pat. No. 3,783,132). Also, oxazolines and imidazolines may be added as rust inhibitors (British Pat. No. 1,317,636). Finally, it is known to use certain amino compounds as corrosion inhibitors (U.S. Pat. No. 3,468,802). However, many of the proposed rust inhibitors show undesirable side effects which impair the applicability of the hydraulic fluid.

SUMMARY OF THE INVENTION

In accordance with the invention there is provided a fire resistant fluid comprising a phosphate ester and a corrosion or hydrolysis inhibiting amount of piperazine or a substituted piperazine.

The fluid of the invention may be useful as a lubricant, a hydraulic fluid, a transformer oil or for a variety of other purposes wherein a fire resistant fluid is required.

DISCUSSION OF SPECIFIC EMBODIMENTS

The problem underlying this invention is to develop a fire resistant fluid having improved characteristics compared to those of known fluids used in hydraulic systems, especially with regard to corrosion inhibition and/or hydrolytic stability.

This is achieved by a fire resistant fluid based on a phosphoric acid ester or a mixture of phosphoric acid esters and containing piperazine and/or at least one piperazine derivative as corrosion and/or hydrolysis inhibitor.

The use of such additives in phosphate esters confers not only improved hydrolytic stability but also better corrosion inhibiting properties; particularly, the rust-preventing properties are improved.

The proportion of piperazine or piperazine derivative in fluids according to the invention is in the range of 0.005 to 5% by weight and is preferably in the range of 0.01 to 0.5% by weight.

The phosphate esters used as the base for fire resistant fluids are mainly aryl esters of phosphoric acid. The triaryl esters are particularly preferred because they are clearly superior in regard to fire resistance but diaryl alkyl phosphate esters may also be employed. The preferred triaryl phosphate esters include, inter alia, tricresyl phosphate ester, trixylyl phosphate ester, phenyl dicresyl phosphate ester, cresyl diphenyl phosphate ester and tri(isopropylphenyl) phosphate ester, di(isopropylphenyl) phenyl phosphate ester and isopropylphenyl diphenyl phosphate ester. Diphenyl-2-ethylhexyl phosphate ester is an example of the diarylalkyl phosphate ester which may be used, although with a clear loss of fire resistance in the fluid. If greater fire resistance is required halogenated phosphate esters may be used, in particular chlorinated aryl esters which, however, have considerable other disadvantages (such as corrosion).

The corrosion and hydrolysis inhibitor may be piperazine itself or a substituted piperazine. Thus, alkyl, aryl, alkaryl and aralkyl substituted piperazines may be used, and the substituent groups may themselves be substituted, for example, by halogen, hydroxy, alkoxy, amino, alkylamino or dialkylamino groups. Other substituent groups on the piperazine ring may be hydroxy, hydroxyalkyl, alkoxy, alkoxyalkyl, alkoxyaryl, amino, aminoalkyl, alkylamino, dialkylamino, alkylaminoalkyl and dialkylamino alkyl. The substitution may be made on the carbon or nitrogen atoms of the piperazine ring. Preferred types of substituted piperazine are:

Alkyl-, Dialkyl-, Trialkyl- or Tetraalkylpiperazine,
N-alkyl-piperazine,
N,N'-Dialkyl-piperazine,
N-Aryl-piperazine,
N,N'-Diaryl-piperazine,
N-Alkylaryl-piperazine,
N,N-Di(Alkylaryl)-piperazine,
N-Hydroxyalkyl-piperazine,
N,N'-Di(hydroxyalkyl)-piperazine,
N-Aminoalkyl-piperazine, and
N,N'-Di(aminoalkyl)-piperazine.

In addition to piperazine and derivatives thereof the fluid according to the invention may also include other additives when this is desirable for particular applications. These other additives may be, for example, metal deactivators, antioxidants and antifoaming agents.

Examples of antioxidants are:

Alkyl and non-alkylated aromatic amine:

Dioctyl-diphenylamine; tertiary octylphenyl-α-naphthylamine; ditertiary octylphenothiazine; phenyl-α-naphthylamine; N,N'-di(sec butyl)-p-phenylenediamine.

Sterically hindered phenols:

2,6-ditertiarybutyl-p-cresol; 2,6-ditertiarybutylphenyl; 2,4,6-triisopropylphenol; 2,2'-thio-bis-(4-methyl-6-tert butylphenol).

Esters of thiodipropionic acid: Dilaurylthiodipropionate ester.

Complex organic chelates: Copper-bis(trifluoracetyl acetonate), copper phthalocyanine, tributyl ester of EDTA.

Examples of antifoaming agents are silicones.

EXAMPLE 1

The effect of the piperazine or piperazine derivatives was tested with regard to rust-preventing properties in accordance with ASTM D-665, Procedure A. The following results were obtained:

TABLE 1

| Formulation | | | Test duration hours | Assessment |
|---|---|---|---|---|
| Phosphate ester A | | | 24 | fail, slight corrosion |
| Phosphate ester A | | | 48 | fail, moderate corrosion |
| Phosphate ester A | + 0.10% | piperazine | 48 | pass |
| Phosphate ester A | + 0.05% | piperazine | 48 | pass |
| Phosphate ester A | + 0.03% | piperazine | 48 | pass |
| Phosphate ester A | + 0.10% | N,N-Dimethylpiperazine | 48 | pass |
| Phosphate ester A | + 0.05% | N,N-Dimethylpiperazine | 48 | pass |
| Phosphate ester A | + 0.10% | N-(2-Aminoethyl) piperazine | 24 | pass |
| Phosphate ester A | + 0.05% | 1-(2-Hydroxyethyl) piperazine | 48 | pass |
| Phosphate ester A | + 0.03% | 1-(2-Hydroxyethyl) piperazine | 48 | pass |
| Phosphate ester A | + 0.10% | N-Phenyl-piperazine | 24 | pass |
| Phosphate ester A | + 0.10% | N-Benzyl-piperazine | 48 | pass |
| Phosphate ester B | | | 24 | fail, heavy corrosion |
| Phosphate ester B | + 0.10% | 2-Methyl-piperazine | 24 | pass |
| Phosphate ester B | + 0.10% | N-Methyl-piperazine | 24 | pass |
| Phosphate ester B | + 0.10% | N,N-Dimethyl-piperazine | 24 | pass |
| Phosphate ester B | + 0.10% | 1-(2-Hydroxyethyl) piperazine | 24 | pass |
| Phosphate ester B | + 0.10% | Piperazine | 24 | pass |
| Phosphate ester C | | | 48 | fail, moderate corrosion |
| Phosphate ester C | + 0.03% | Piperazine | 48 | pass |

Phosphate ester A: Triaryl phosphate ester (inhibited), 38 cSt/40° C.
Phosphate ester B: Triaryl phosphate ester (uninhibited), 22 cSt/40° C.
Phosphate ester C: Triaryl phosphate ester (uninhibited), 43 cSt/40° C.

EXAMPLE 2

The effect of the piperazine derivatives was tested with regard to hydrolytic stability in accordance with the BBC Hydrolytic Stability Test (BBC ZLC 2-5-40, 100° C., 96 hours, (no clay treatment). The results of the tests are as follows:

TABLE 2

| Formulation | | Neutralization Number Increase mg KOH/g |
|---|---|---|
| Phosphate ester A | | 5.1 |
| Phosphate ester A | + 0.20% N-(2-Aminoethyl)piperazine | 1.96 |
| Phosphate ester A | + 0.20% N,N'-Dimethyl-piperazine | 1.42 |
| Phosphate ester A | + 0.20% N-Methyl-piperazine | 1.65 |
| Phosphate ester A | + 0.20% 2.5-Dimethyl-piperazine | 1.29 |
| Phosphate ester A | + 0.20% 2-Methyl-piperazine | 1.13 |
| Phosphate ester A | + 0.20% 1-(2-Hydroxyethyl)-piperazine | 1.09 |
| Phosphate ester A | + 0.20% Piperazine | 1.77 |
| Phosphate ester D | | 0.99 |
| Phosphate | | |

TABLE 2-continued

| Formulation | | Neutralization Number Increase mg KOH/g |
|---|---|---|
| ester D Phosphate | + 0.05% 1-(2-Hydroxyethyl)-piperazine | 0.69 |
| ester E Phosphate | + 0.05% Piperazine | 0.45 |
| ester E | + 0.05% 1-(2-Hydroxyethyl)-piperazine | 0.30 |
| Phosphate ester D: | Triaryl phosphate ester (inhibited), 43 cSt/40° C. | |
| Phosphate ester E: | Triaryl phosphate ester (inhibited), 43 cSt/40° C. | |

In Tables 1 and 2, Esters A-E are mixtures of the following:

Tri(isopropylphenyl) phosphate, di(isopropylphenyl) phenyl phosphate, isopropylphenyl diphenyl phosphate and triphenyl phosphate.

I claim:

1. A fluid comprising a phosphate ester and a corrosion or hydrolysis inhibiting amount of piperazine substituted with an alkyl, alkaryl, hydroxy, hydroxyalkyl, alkoxy, alkoxyalkyl, alkoxyaryl, amino, aminoalkyl, alkylamino, alkylaminoalkyl, a dialkylamino or a dialkylaminoalkyl group.

2. The fluid of claim 1 wherein said phosphate ester is an aryl ester of phosphoric acid.

3. The fluid of claim 2 wherein the aryl ester is a diaryl ester.

4. The fluid of claim 3 wherein the diaryl ester is diphenyl-2-ethylhexyl phosphate.

5. The fluid of claim 2 wherein the aryl ester is a triaryl ester.

6. The fluid of claim 5 wherein the triaryl ester is selected from the group consisting of tricresyl phosphate, trixylyl phosphate, phenyl dicresyl phosphate, cresyl diphenyl phosphate, and tri(isopropylphenyl) phosphate.

7. The fluid of claim 1 wherein the substituent is itself substituted with a member selected from the group consisting of halogen, hydroxy, alkoxyl, amino, alkylamino and dialkylamine.

8. The fluid of claim 1 wherein the inhibitor is N,N'-dimethyl piperazine.

9. The fluid of claim 1 wherein the inhibitor is 2-methyl piperazine.

10. The fluid of claim 1 wherein the inhibitor is N-methyl piperazine.

11. The fluid of claim 1 wherein the inhibitor is 1-(2-hydroxyethyl) piperazine.

12. The fluid of claim 1 wherein the inhibitor is N-(2-aminoethyl) piperazine.

13. The fluid of claim 1 wherein the inhibitor is N-phenyl piperazine.

14. The fluid of claim 1 wherein the inhibitor is N-benzyl piperazine.

15. The fluid of claim 1 wherein the inhibitor is 2,5-dimethyl piperazine.

* * * * *